US012077254B2

(12) United States Patent
Louden

(10) Patent No.: US 12,077,254 B2
(45) Date of Patent: Sep. 3, 2024

(54) MULTI-SEGMENT RECREATIONAL BOARDS

(71) Applicant: Dock Master, LLC, Lakeville, MN (US)

(72) Inventor: Craig Cole Louden, Lakeville, MN (US)

(73) Assignee: Dock Master, LLC, Lakeville, MN (US)

( * ) Notice: Subject to any disclaimer, the term of this patent is extended or adjusted under 35 U.S.C. 154(b) by 428 days.

(21) Appl. No.: 17/510,791

(22) Filed: Oct. 26, 2021

(65) Prior Publication Data

US 2023/0129414 A1 Apr. 27, 2023

(51) Int. Cl.
*B63B 32/53* (2020.01)

(52) U.S. Cl.
CPC ..... *B63B 32/53* (2020.02)

(58) Field of Classification Search
CPC ..... B63B 32/53
See application file for complete search history.

(56) References Cited

U.S. PATENT DOCUMENTS 3,409,920 A * 11/1968 Brownley ..... B63B 32/53 441/74
3,996,868 A * 12/1976 Schagen ..... B63H 8/20 441/74
7,029,350 B2 * 4/2006 Katzfey ..... B63B 32/53 114/77 R
7,347,755 B1 * 3/2008 Katzfey ..... B63B 32/53 441/74
7,794,297 B1 * 9/2010 Katzfey ..... B63B 32/53 441/74
8,469,756 B2 * 6/2013 Becker ..... B63B 32/53 441/74
10,864,970 B2 * 12/2020 Peterson ..... F16B 7/0406
2005/0247248 A1 * 11/2005 Caplan ..... B63B 32/40 114/66
2013/0231014 A1 * 9/2013 Knutson ..... B63H 1/32 440/21

(Continued)

FOREIGN PATENT DOCUMENTS

DE 102018003227 A1 * 1/2019 ..... B63B 32/53
ES 2831549 A1 * 6/2021 ..... B63B 32/53

OTHER PUBLICATIONS

"Easy Eddy: The World's First Lightweight Collapsible SUP", YouTube video, posted May 24, 2019 URL: < https://www.youtube.com/watch?v=f9tA5RQb_Y8> Accessed on the Internet Jan. 25, 2021 (3 pages).

(Continued)

*Primary Examiner* — S. Joseph Morano
*Assistant Examiner* — Jovon E Hayes
(74) *Attorney, Agent, or Firm* — Padda Law Group

(57) ABSTRACT

Recreational board such as paddleboards and surfboards, and methods of assembling and disassembling the recreational boards, the boards including a front portion, a back portion, and a plurality of elongated supports extending between the front portion and the back portion and located within, and removable from, recesses in the front portion and/or the back portion. The recreational board may further include a releasable fastening element securing connecting the front portion to the back portion.

20 Claims, 16 Drawing Sheets

(56) References Cited

U.S. PATENT DOCUMENTS

2014/0315454 A1* 10/2014 Barr ..... B63B 32/53
441/74

OTHER PUBLICATIONS

"Cheap portable tint sup paddle standup paddle board easy to carry/paddle surfing board", Alibaba product listing, URL: <https://www.alibaba.com/product-detail/cheap-portable-tint-sup-paddle-standup_60723147637.html?spm=a2700.galleryofferlist.normal_offer.d_title.608b5763nlEihc> Accessed on the Internet Jan. 25, 2021 (10 pages).

* cited by examiner

MULTI-SEGMENT RECREATIONAL BOARDS

FIELD OF INVENTION

The present invention relates to recreational boards such as paddleboards that are configured to be disassembled into multiple sections for easy transportation and storage, and reassembled for use.

BACKGROUND OF INVENTION

Various floating boards are known for recreational use for standing, kneeling, or lying on the surface of the water and moving through the water, such as paddleboards and surfboards.

Conventional surfboards are popular but are large and heavy and very difficult and inconvenient to move, transport and store. Paddleboard have increased in popularity in recent years. Paddleboards may be used as a way of integrating core fitness and balance challenges into a recreational activity. An example is the stand-up paddleboard, commonly referred to as a SUP. As with surfboards, a problem faced by the users is carrying and transporting the paddleboard. Due to their size, SUP boards are difficult to carry and transport from location to location. In addition, these elongated boards take up a considerable amount of storage space that many users do not have.

Some board makers have attempted to address the transportation and storage problems through use of boards including two half sections joined by a hinge and other methods, but such boards are problematic due a lack of strength and other problems. Boards used in sports must be strong and secure for weight bearing while also withstanding pressure from the waves.

SUMMARY OF THE INVENTION

It is an object of the present invention to provide a strong and secure board such as a paddleboard which can be easily separated and rejoined.

Various embodiments include recreational boards such as paddleboard and surfboards having multiple sections. In some embodiments, the recreational board includes a front portion having a top surface, a bottom surface, an outer edge, and an inner side, the inner side comprising a plurality of recesses, and a back portion having a top surface, a bottom surface, an outer edge, and an inner side, the inner side comprising a plurality of recesses, wherein the inner side of the front portion abuts the inner side of the back portion when the board is configured for use. The board further include a plurality of elongated supports extending between the recesses of the front portion and the recesses of the back portion and a releasable securing element fastening the front portion to the back portion.

In some embodiments, the supports are enclosed within the board. In some embodiments, the plurality of supports comprises at least three supports. The plurality of elongated supports may be removable from the recesses of the front portion or the back portion, or may be removable and replaceable within the recesses of both the front and back portions In some embodiments, the recreational board includes a carrying case sized to fit the reactional board in a disassembled configuration with the front portion and the back portion overlying each other.

In some embodiments, the releasable securing element comprises a connector that spans a location at which the inner side of the front portion abuts the inner side of the back portion. In some such embodiments, the releasable connector is located within a recess in the outer edge of the front portion and the back portion. In some embodiments, the recreational board further includes a second releasable connector spanning a location at which the inner side of the front portion abuts the inner side of the back portion and within a second recess in the outer edge of the front portion and the back portion.

In some embodiments, the releasable securing element comprises a cylindrical element inserted through the top surface of the front or back portion to lock the support in place, holding the front portion to the back portion.

Other embodiments of a recreational board include a front portion having a top surface, a bottom surface, an outer edge, and an inner side, the inner side comprising a plurality of recesses, and a back portion having a top surface, a bottom surface, an outer edge, and an inner side, the inner side comprising a plurality of recesses, wherein the inner side of the front portion abuts the inner side of the back portion when the board is configured for use. The recreational board further includes a plurality of elongated supports extending between the recesses of the front portion and the recesses of the back portion, wherein the elongated supports are removable from the recesses when the front and back portions are separated. The recreational board further includes a recessed cavity within the outer edge of the front and back portions, spanning a location of abutment between the front portion and the back portion and a releasable locking connector within the cavity, the releasable locking connector comprising a front component attached to the front portion and a back component attached to the back portion. In some embodiments, the plurality of elongated supports includes four supports. In some embodiments, the recreational board is buoyant.

In some embodiments, the releasable locking connector automatically locks when the front component slides into the back component or when the back component slides into the front component.

Other embodiments include methods of assembling a multipiece recreational board and method of disassembling a multipiece recreational board. In some embodiments, the method of assembling a multipiece recreational board includes the steps of positioning a front portion of the board on a surface, the front portion including a top surface, a bottom surface, an outer edge, and an inner side, the inner side comprising a plurality of recesses and positioning a back portion of the board on the surface, the back portion including a top surface, a bottom surface, an outer edge, and an inner side, the inner side comprising a plurality of recesses. The method further includes the step of inserting a plurality of elongated supports into the plurality of recesses of the front portion and/or of the back portion and then sliding the front portion and the back portion together, with the inner side of the front portion abutting the inner side of the back portion and with the elongated supports extending from the front portion to the back portion within the recesses of the front portion and the back portion.

In some embodiments, the method includes, either during or after the step of sliding the front portion and the back portion together, engaging a releasable securing element to releasable connect and lock the front portion to the back portion. In some embodiments, the method includes, either during or after the step of sliding the front portion and the back portion together, engaging a pair of connectors to releasable connect the front portion to the back portion. In some such embodiments, the pair of connectors are located on the outer edge of the board and extending across a location of abutment between the front portion and the pack portion.

In some embodiments, engaging a connector comprises automatically engaging a connector while sliding the front portion and the back portion together.

In some embodiments, the method includes, prior to the steps of positioning the front and back portions on a surface, removing the front portion, the back portion, and the plurality of supports from a container, wherein the front portion and back portion are stacked on top of each other within the container.

DETAILED DESCRIPTION DRAWINGS

Figure 1:
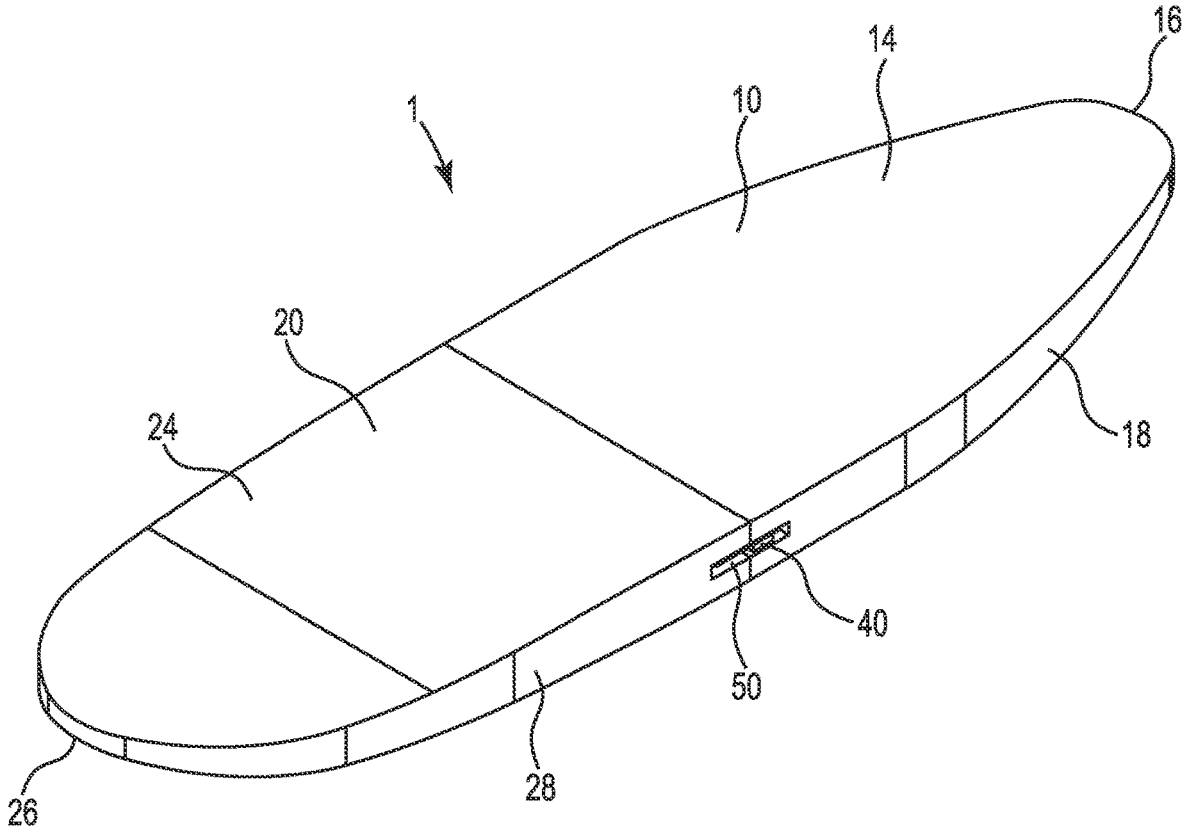
FIG. 1 is a top perspective view showing a board according to various embodiments in an assembled configuration for use.

The present invention is capable of various modifications and various embodiments, and specific embodiments are illustrated in the drawings and will be described in detail in the detailed description. It is to be understood, however, that the invention is not to be limited to the specific embodiments, but includes all modifications, equivalents, and alternatives falling within the spirit and scope of the invention.

Hereinafter, the present invention will be described in detail with reference to the accompanying drawings.

The terminology used in this application is used only to describe a specific embodiment and is not intended to limit the invention. The singular expressions include plural expressions unless the context clearly dictates otherwise. In the present application, the terms "comprises" or "having" and the like are used to specify that there is a feature, a number, a step, an operation, an element, a component or a combination thereof described in the specification, but do not preclude the presence or addition of one or more other features, integers, steps, operations, elements, components, or combinations thereof.

The terms first, second, etc. may be used to describe various components, but the components should not be limited by the terms. The terms are used only for the purpose of distinguishing one component from another.

Various embodiments include recreational boards, such as boards used for watersports, including surfboards, paddleboards, and windsurfing boards, for example. The boards are configured to be divided into multiple segments, such as two, for storage and transportation, and reassembled into a full board for use as desired. The board includes removable internal supports to provide a backbone of strength and stability, as well as releasable connectors to secure the segments of the board together in the use configuration.

Figure 2:
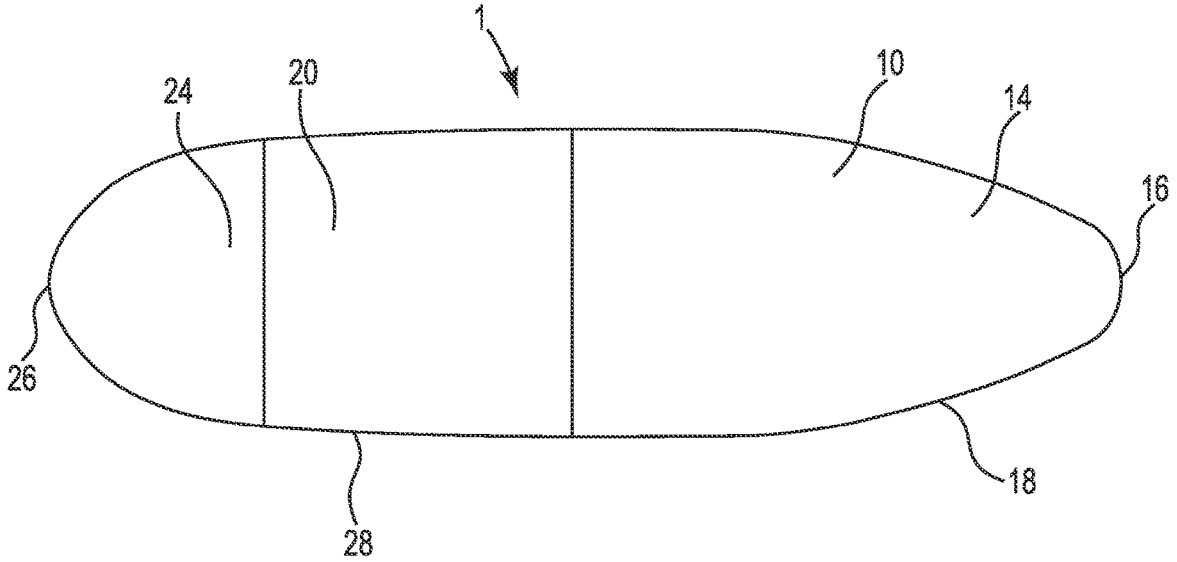
FIG. 2 is a top view of the board of FIG. 1.
Figure 3:
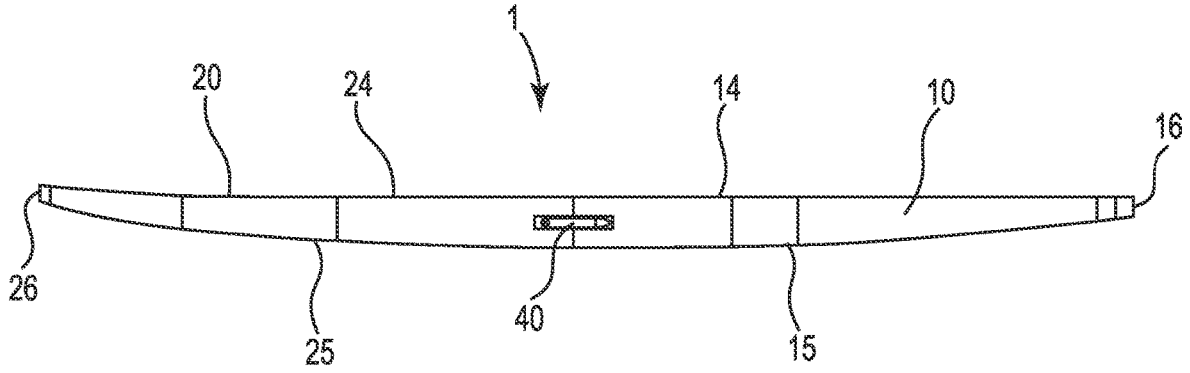
FIG. 3 is a side view of the board of FIG. 1.

FIG. 1 is a top perspective view showing a configuration of a board 1 which can be separated and combined according to various embodiments. FIG. 2 is a top view of the board 1 and FIG. 3 is a side view of the board 1, also showing the front portion 10 and the back portion 20 in the connected configuration for use. The separable and combinable board 1 comprises a front portion 10 and a back portion 20 in the form of elongated and generally flat plates, each forming approximately one half of the paddle board 1, though the board 1 could alternatively be divided into portions of unequal lengths and/or additional portions.

The front portion 10 and the back portion 20 are substrates that can be separated from each other. The front portion 10 and the back portion 20 may have a generally flat plate shape like a conventional board for general use and the length of the plates is not particularly limited. The front portion 10 and the back portion 20 constitute the body of the board 1 according to various embodiments, and each of the front portion 10 and the back portion 20 may be buoyant bodies that can float in water. Furthermore, although this disclosure describes the board 1 has having two segments, in other embodiments the board 1 may be divided into additional segments such as three or four, which may be configured to separate and rejoin according to the methods described herein for the two-segment embodiment shown.

Various embodiments may be characterized as a board 1 for recreational use such as water use including a front portion 10 and a back portion 20, each forming approximately half of the board 1, and each of these portions can be separated and combined through a coupling. Therefore, the respective portions are used in combination when the board 1 is used for activities, and the respective portions can be separated and moved easily for storage or transportation.

The front portion 10 includes a top surface 14, a bottom surface 15, a front end 16 an inner side 12, and an outer edge 18. Similarly, the back portion 20 includes a top surface 24, a bottom surface 25, a back end 26, an inner side 22, and an outer edge 28. The front end 16 and the back end 26 may have a slight taper, with the front end 18 more tapered than the back end 28 in some embodiments. In addition, the ends 16, 26 and the outside edges 18, 28 of the board 1 may be rounded. The thickness of the board 1 may vary depending on, for example, the length of the board 1. The board may optionally have one or more projections, such as a projection on the lower surface, such as a skeg or fin associated therewith at the bottom of the back section, which may be either fixed or detachable.

The materials and components of the board 1 for use in the present invention are not particularly limited and may be manufactured in various ways using all materials or components known to those of ordinary skill in the art. Examples of materials which may be used for the front and back portions of the board include buoyant materials such as foam including foam such as SUP Foam, wood, plastic, recycled plastic wood, and other materials alone or in combination. In some embodiments, recycled plastic wood for the sides, such as to hold in straps. In some embodiments, the board may include a stringer as an elongated piece of higher strength material extending longitudinally through the center of the board. In some embodiments, the stringer may be wood.

Figure 4:
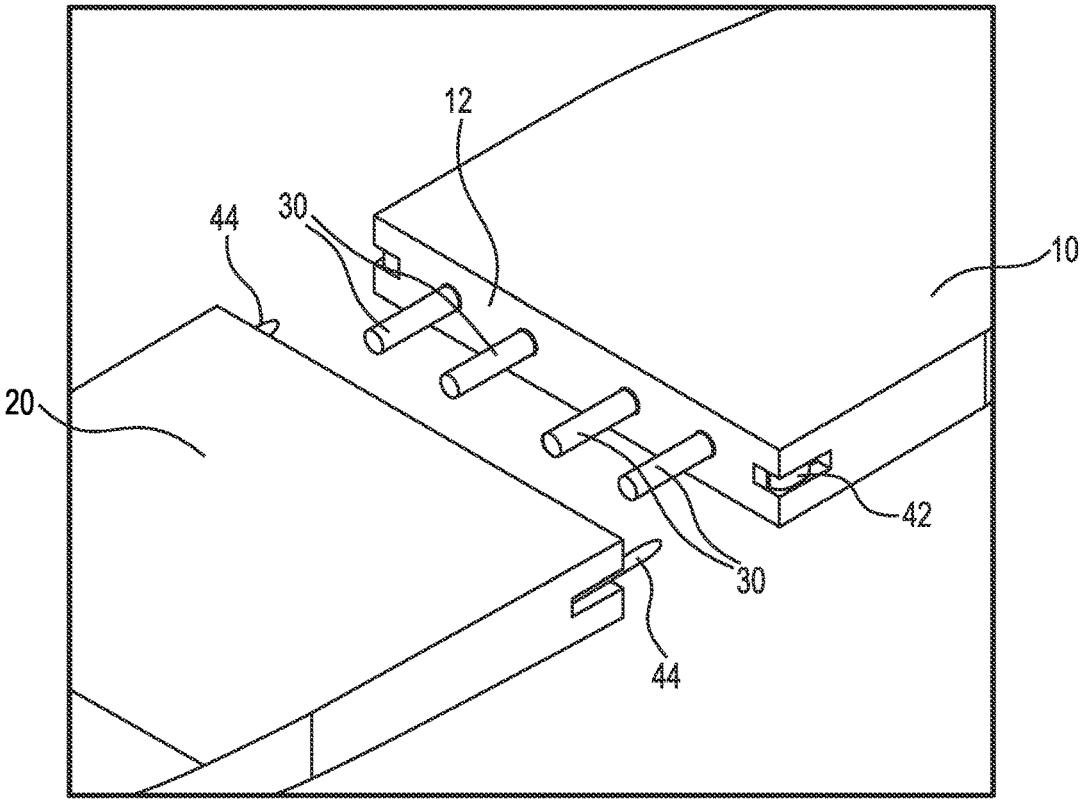
FIG. 4 is a partial top perspective view of the board of FIG. 1 in a disconnected configuration.

In FIGS. 3 and 4, the board 1 is shown with the front portion 10 separated from the back portion 20, as during assembly or disassembly. Front portion 10 includes inner side 12 which faces inner side 22 of the back portion 20. When front portion 10 and back portion 20 are brought together to configure the board 1 for use, inner side 12 abuts inner side 22. Inner sides 12 and 22 extend across the board 1, from the top surfaces 14, 24 to the bottom surfaces 15, 25, and are oriented perpendicular to the longitudinal axis of the board 1.

Figure 5:
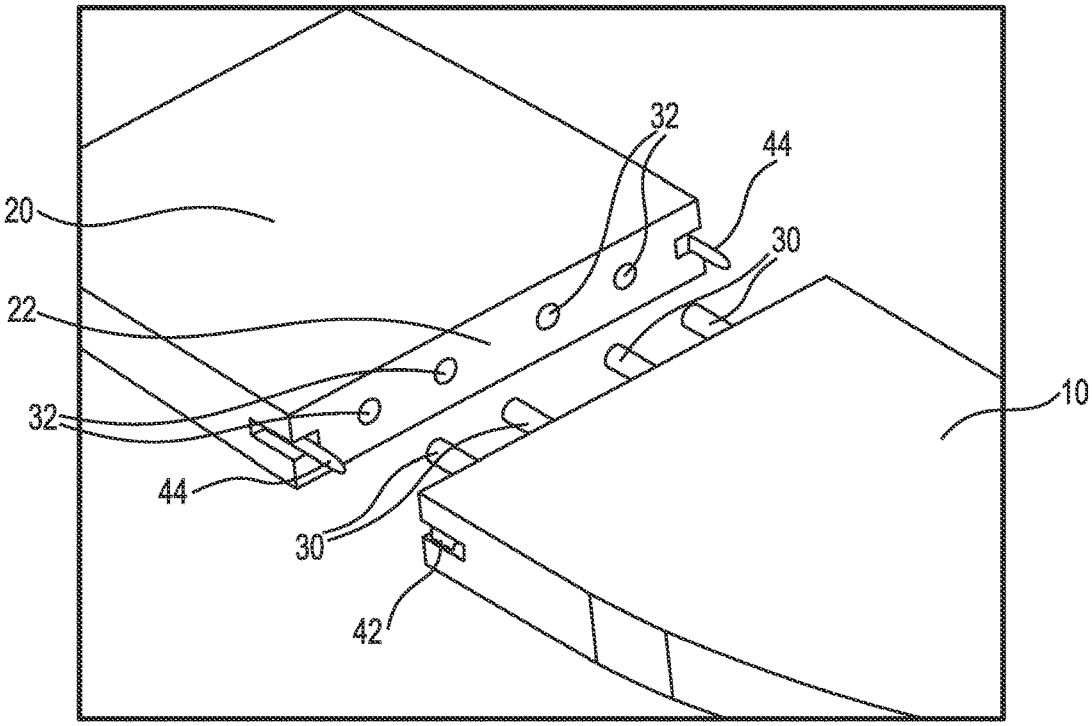
FIG. 5 is another partial top perspective view of the board of FIG. 1 in a disconnected configuration.

As shown in FIGS. 4 and 5, there are a plurality of supports 30 that extend between and into the front portion 10 and the back portion 20. The supports 30 are elongated structural supports that fit into recesses 32 in inner sides 12 and 22. The recesses 32 in inner side 12 align with the recesses in inner side 22 when the front and back portions 10, 20 are brought together. The recesses 32 act as receiving portions for the ends of the supports 30. The recesses 32 may be holes or cavities extending into the front and back portions 10, 20, into the space between their top surfaces 14, 24 and bottom surfaces 15, 25. The size of the recesses 32 is not particularly limited but is large enough to accommodate a part of the support 30.

The board 1 includes a support system engageable with both the front portion 10 and the back portion 20. In alternative embodiments including additional segments, such as a front portion, middle portion and back portion, there may be a supports system provided between each adjoining segment, to securely bring the segments together with the outer surfaces of the segments being streamlined as a continuous and smooth board. The support system is not particularly limited. One example of this will be described later in detail.

The supports 30 are sufficiently long to extend into each recess 32 to provide strength and connection while allowing the front and back portions 10, 20 to come together in fully abutting alignment. The recesses 32 have a shape corresponding to the end of the supports 30 or a shape accommodating the end of the supports 30 so that the supports 30 can be inserted into the recesses 32. In some embodiments, the ends of the supports 30 may fit snugly within the recesses 32. A snug fit may assist with assembly of the board 1, as the end of the support 30 may be held in place within the recess 32 by friction, making it easier to bring the front portion 10 and back portion 20 together without the supports 30 falling out. In addition, a snug fit may prevent the supports 30 from wobbling within the recesses 32 during use.

The length of the supports 30 is not particularly limited. The supports 30 may be long enough to extend sufficiently into the front and back portions 10, 20 to strengthen the board 1 but shorter than the total length of the front portion 10 and the back portions 20 so as to remain completely internal to and encased within the board 1. The length and width of the supports 30 may depend upon the size of the board with which they are used. For example, in some embodiments the supports 30 may be about between about 6 inches and about 50 inches long, or between about 10 and about 40 inches long. In embodiments such as single person paddle boards, the supports 30 may be between about 8 and about 24 inches long. In some such embodiments, the supports 30 may have a width or cross-sectional dimension of about 1½ inch to about 2 inches, such as about 1 inch or about 1¼ inch or about 1½ inches or about 2 inches, which may be the diameter of the support 30, and a length of about 12 to about 20 inches, or about 14 to about 18 inches, such as about 16 inches. In other embodiments such as two-person paddle boards, the supports 30 may be between about 16 to about 40 inches long. In some such embodiments, the supports may have a width or cross section dimension of about ½ inch to about 2 inches, such as about 1 inch or about 1¼ inch or about 1½ inch or about 2 inches, which may be the diameter of the support 30, and a length of about 18 inches to about 30 inches, or about 20 inches to about 28 inches, or about 22 to about 26 inches, such as about 24 inches. In use, approximately one half of the length of the supports 30 may extend into the front portion 10 and approximately one half of the supports 30 may extend into the back portion 20, or the supports 30 may extend more into one portion than the other. The supports 30 may be formed from a strong material, such as a material stronger than the material used in the board 1, so that the board 1 is very strong when connected at the midpoint of the board 1, even when a user is standing at that point. In this way, it is possible to provide a large coupling force. Examples of the materials which may be used in the supports 30 various embodiments include strong plastic, metal, wood, and/or other strong materials.

In some embodiments, the supports 30 may be elongated tubes or rods or other elongated members that may solid or hollow. In some embodiments, the supports 30 may be cylindrical in shape. The recesses 32 provided on the inner sides 12, 22 of the front and back portions 10, 20 may be of the same shape as the ends of the supports 30 to accommodate the supports 30. The shape of supports 30 can alternatively have a different profile and the recesses 32 may have a matching shape to accommodate the supports 30, such as rectangular, triangular, oval, or any other shape. In the embodiment shown, all of the supports 30 are of the same length and have the same shape. However, in alternative embodiments the supports 30 could vary in length and/or shape, with the recesses 32 also varying in size and shape to match the supports 30.

The recesses 32 may be shaped as elongated linear cavities within the front and back portions 10, 20. The recesses 32 may have a single opening, located at the inner sides 12, 22, with the interior walls of the recesses 32 being complete such that, in the case of boards having a hollow center, they do not provide a passage for the entry of water inside the front and back portions 10, 20 of the board 1.

In the embodiments shown, the board 1 includes four supports. However, the board 1 could alternatively include fewer supports 30, such as one, two or three supports 30, or more supports 30, such as five, six, or seven supports 30. In some embodiments, the use of multiple supports 30, such as at least two or at least three supports 30, spread across the width of the board 1 and within the board 1, may be preferable for providing enhanced strength at the line of abutment between the front portion 10 and the back portion 20. However, in alternative embodiments the board 1 may optionally include only one support 30, with additional strength provided by the connectors 40 at the sides of the board 1, which may also prevent rotation of the front and back portions 10, 20 relative to each other about the axis of the single support 30. In some such embodiments, the single support 30 (and the corresponding recesses 32) may be shaped to enhance strength and prevent rotation, such as through the use of a widened support, such as a support 30 having a wide rectangular cross sectional shape, extending toward the outer edges 18, 28 and parallel to the top surfaces 14, 24, and bottom surfaces 15, 25.

As seen in the side view shown in FIG. 3, the board 1 also includes external connectors 40 which functional as releasable securing elements to fasten the front portion 16 to the back portion 26 when in an assembled configuration. The connector 40 can be seen closeup in FIGS. 6 and 7, which show the connector 40 in closed and open configurations, respectively. The connectors 40 securely join the front portion 10 to the back portion 20, spanning the line of abutment between them, on opposite sides of the board 1. The connectors 40 are located on the outer edges 18, 28, within recesses 50. In this way, the connectors 40 do not project beyond the smooth outer surface of the board 1, making them safer and less likely to scrape or injure a user and also less likely to be damaged in collisions. The connectors 40 may be of various types such as straps, bindings, clamps, buckles, hook and loop material, etc.

Figure 6:
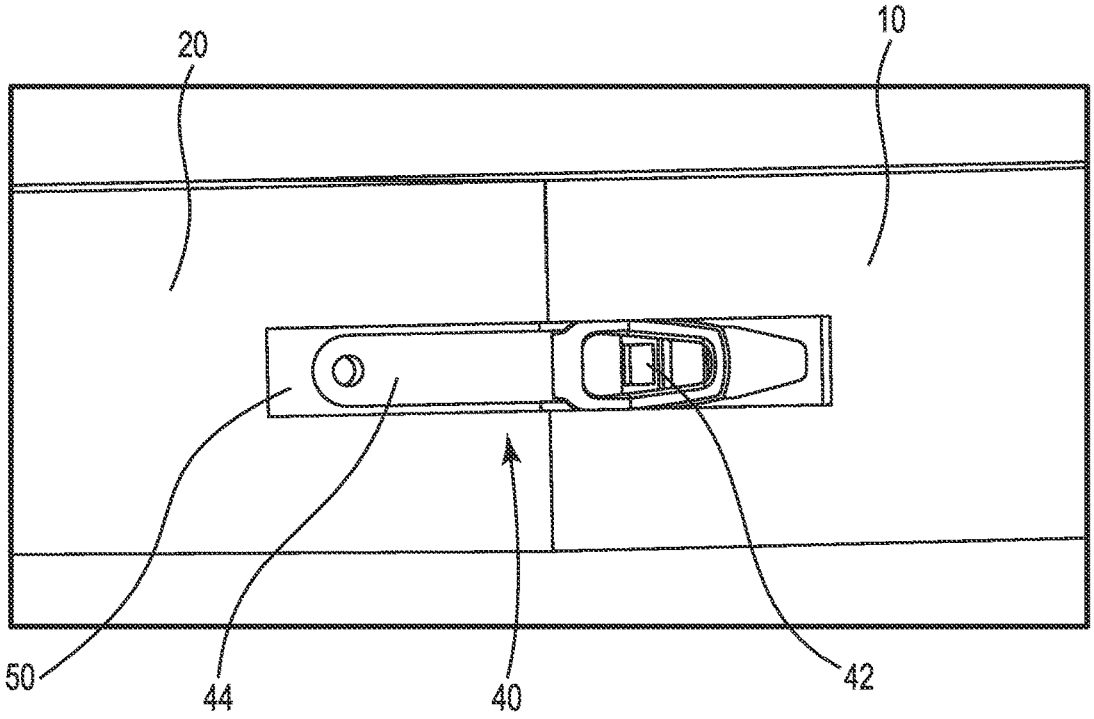
FIG. 6 is a partial closeup side view of a connector of the board of FIG. 1 in a connected configuration.

The pair of connectors 40 in the embodiment shown in the figures include front components 42 and back components 44. The front components 42 are attached to the front portion 10 of the board 1, along the outer edge 18 and adjacent to the inner side 12. The back components 44 are attached to the back portion 20 of the board 1, along the other edge 28 and adjacent to the inner side 22. As shown in FIG. 6, the front and back portions 10, 20 of the board 1 are held in a connected configuration by the connectors 40.

The front components 42 and back components 44 of the connector 40 may have features corresponding to each other, so that they can overlap with each other or can be engaged with each other, thereby being able to be releasably locked together. For example, the components 42, 44 may have a sliding fastening structure, so they may be slidably engaged with each other. That is, the connector components 42, 44 may have a shape corresponding to each other such that can be coupled to and separated from each other.

Figure 7:
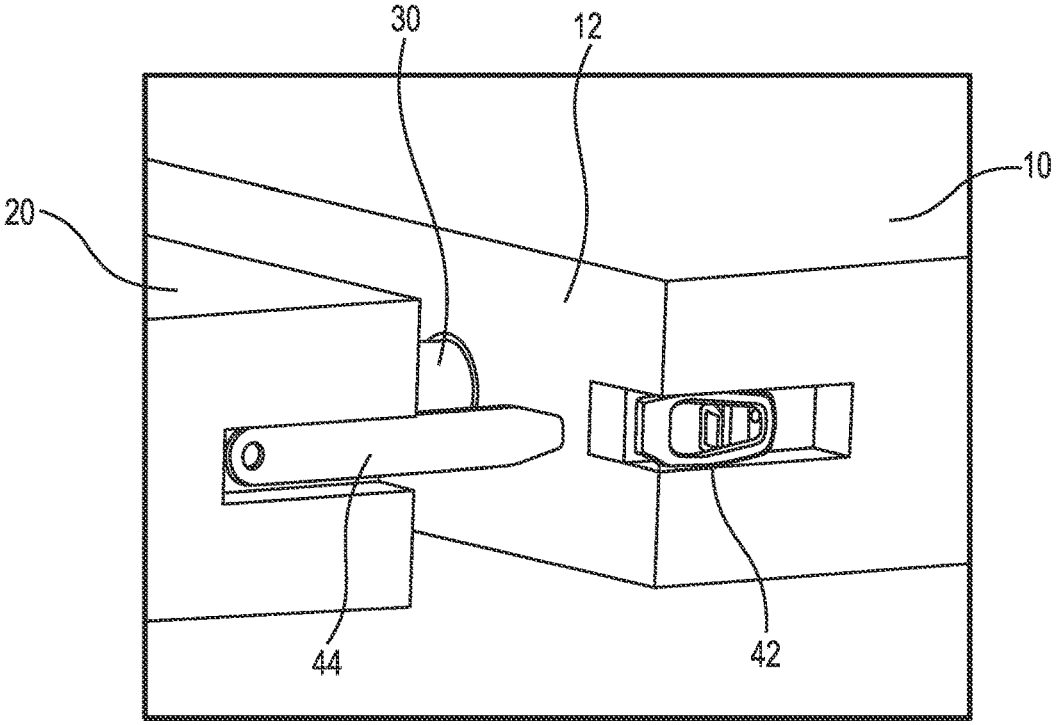
FIG. 7 is a partial closeup side view perspective of the connector of FIG. 4 in a disconnected configuration.

In the example shown in FIGS. 6 and 7, the back component 44 of the connector 40 is an extending portion while the front portion 42 is an accommodating portion which may have a shape configured to receive and releasably lock with the extending portion. In alternative embodiments, one or both of the front components 42 may be extending portions while one or both of the back components 44 may be accommodating portions.

The size, length, and/or volume of the accommodating portion may be equal to or slightly larger than the extending portion for enhancing the coupling force and facilitating easy separation. Since the extending portion and the accommodating portion can be a strap, binding, clamps, buckle etc., it may be useful for providing a large releasably locking force for adjoining the front and back portions 10, 20 of the board 1 together. In some embodiments, the extending portion may automatically insert into the accommodating portion when the front and back portions 10, 20 of the board 1 are brought together with the supports 30 within them and may further automatically lock the front and back portions 10, 20 of the board 1 together.

The widths of the front component 42 and back component 44 of the connector 40 are not particularly limited but are generally smaller than the thickness of the front and back portions 10, 20 of the board. That is, even if the front and back components 42, 44 are engaged with each other, generally the thickness of the connector 40 is less than the thickness of each of the front and back portions 10, 20 of the board 1. Although the board 1 according to various embodiments may be formed by the joining of the front and back portions 10, 20, since the thickness is uniformly smooth as a whole, it can have a slender shape as if it were a conventional single piece board.

In alternatively embodiments in which the board includes more than two sections or portions, each section or portion may be connected to the adjacent section or portion using supports and recesses as described herein and connectors as described herein.

Figure 8:
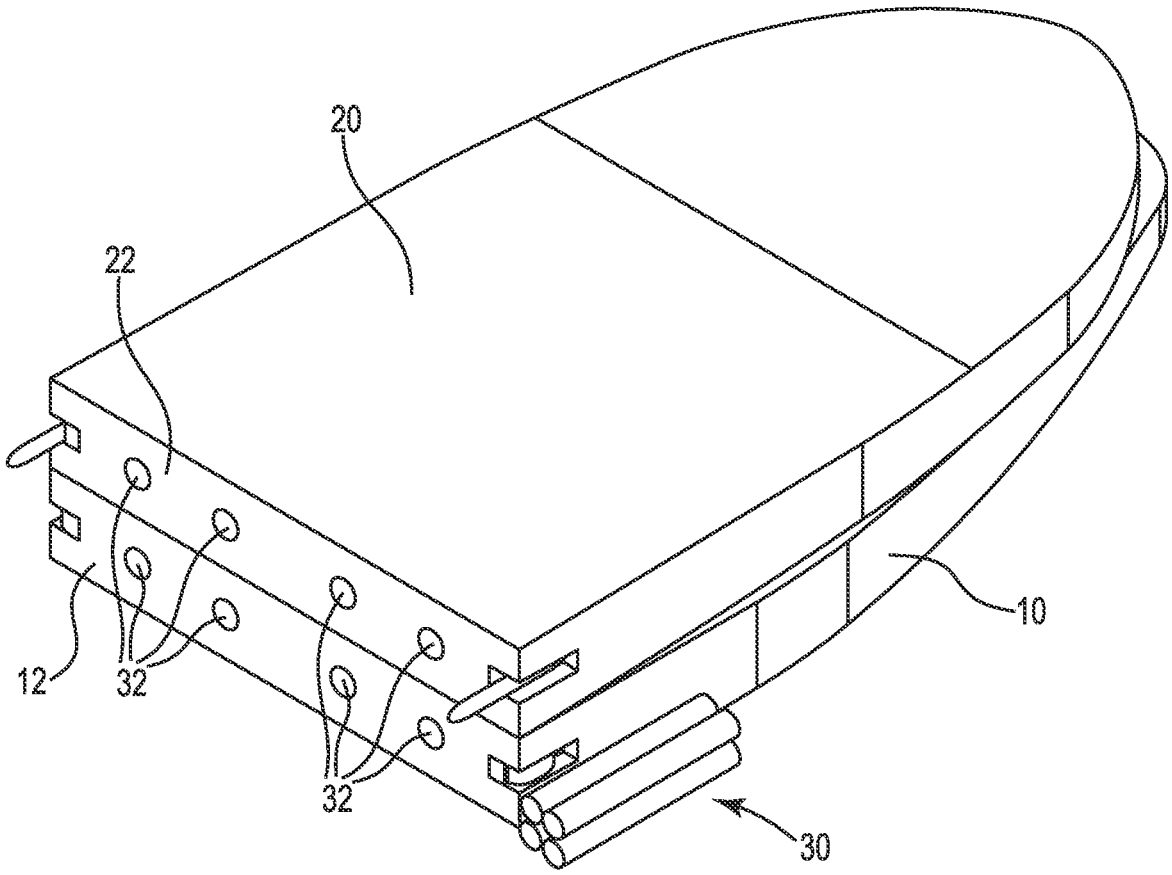
FIG. 8 is a top perspective view of the board of FIG. 1 in a disconnected and stacked configuration.

FIG. 8 is a side perspective view showing the board 1 in a fully disassembled configuration with the supports 30 completely removed from the front portion 10 and the back portion 20. The empty recesses 32 can be seen within the inner sides 12, 22 of the front portion 10 and the back portion 20. The front and back portions 10, 20 are stacked, as during storage when the board 1 is not in use. The board 1 could similarly be stored in this configuration or placed in a container such as a carrying bag, for example. It can be appreciated that the board is much more manageable in this disassembled configuration, yet it could be quickly and easily transported and reassembled into a use configuration as desired by a user.

Furthermore, the present invention includes a methods of assembling and of disassembling a board 1 according to various embodiments.

In some embodiments, a user may assemble a board 1 according to various embodiments by arranging the front and back portions 10, 20 of the board 1 in proximity to each other on a surface such as the ground, a dock, or a boat deck. The user may then insert one end of the supports 30 into the recesses 32 of either the front portion 10 or the back portion 10 of the board 1. Next the user may align the recesses 32 of the other of the front portion 10 or back portion 20 with the free ends of the supports 30 and then slide the front and back portions 10, 20 together, such that the supports 30 slide into the recesses 32 of the front or the back portions 10, 20. Depending upon the type of connectors 40 present on the board 1, the connectors 40 may automatically engage in a closed position when the front and back portions 10, 20 of the board are brought together. Alternatively, a user may engage the connectors 40 in a closed position after bringing the front and back portions 10, 20 of the board 1 together.

In the above method of assembly, the user inserted all of the supports 32 into one of the front or back portions 10, 20 of the board. A user could alternatively insert some of the supports 30 into the recesses 32 front portion and some into the recesses 32 of the back portion 20, and then bring the two portions 10, 20 together. In embodiments with more than two portions, the steps may be repeated for each of the adjoining portions.

To disassemble the board 1, a user may first disengage the connectors 40 to release the connection. The user may then pull the front and back portions 10, 20 away from each other to separate them. Once the front and back portions 10, 20 of the board are sufficiently separated to allow removal of the supports 32, such as once at least one end of the supports is exposed, the user may then pull the supports 32 to slide them out of the recesses 32. In embodiments including more than two portions, the steps may be repeated for each of the adjoining portions. Once disassembled, the front and back portions 10, 20 may be stacked on top of each other, such as in a storage or transportation containers, along with the supports 30

In the embodiments described above, the supports 30 are fully enclosed within the board 1 and fully removable when the front and back portions 10, 20 are separated. In alternative embodiments, the supports 30 may not be fully removable. For example, the supports 30 may extend out of and be permanently affixed within the front portion 10 or the back portion of the board 1 (or a combination of the front and back portions 10, 20 of the board) with the free end of the support 30 projecting outward. The other portion of the board 1 without the affixed supports 30 may include recesses 32, spaced and positioned to align with the supports 30, into which the free ends of the supports 32 may be inserted when the front and back portions 10, 20 of the board are brought together during assembly. Embodiments in which the supports 30 are fully removable allow for easier storage and transportation of the front and back portions 10, 20 of the board. However, in some embodiments it may still be preferable for the supports 30 to be affixed to the front or back portion 10, 20 of the board 1, such as to prevent loss of the supports 30.

Figure 9:
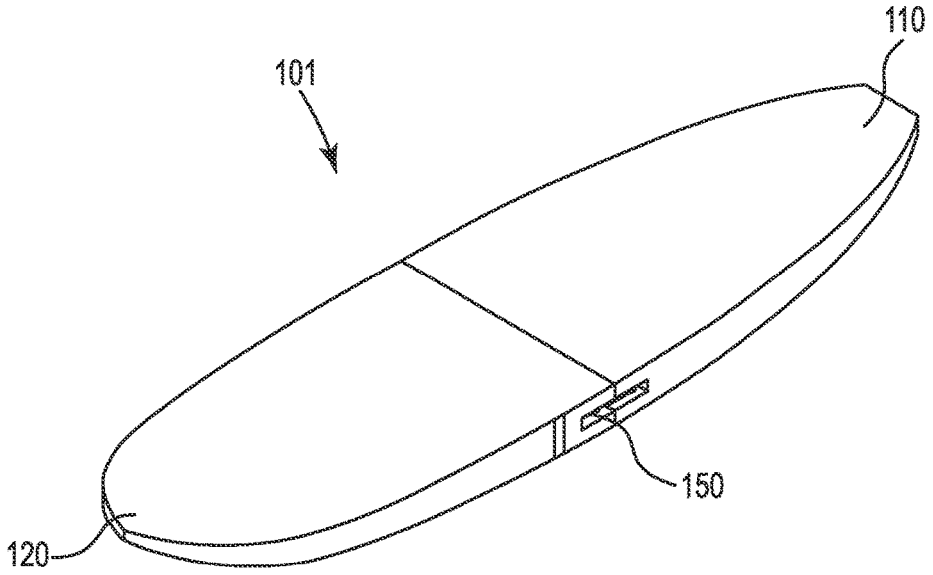
FIG. 9 is top perspective view of an alternative board according to various embodiments in an assembled configuration for use.
Figure 10:
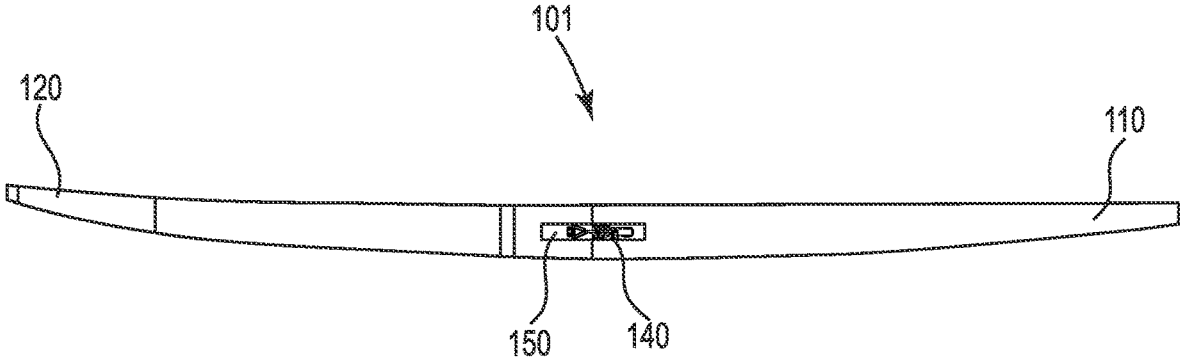
FIG. 10 is a side view of the board of FIG. 9.

An alternative embodiment is shown in FIGS. 9-16. In this embodiment, the board 101 is like board 1 in the previous examples but the supports 130 and connector 140 are modified. FIGS. 9 and 10 show a top perspective view and a side view of the board 101 in an assembled configuration. The board includes a front portion 110 and a back portion 120 and a pair of connectors 140 on the outer edge of the board within recesses 150 on each side of the board 101.

Figure 11:
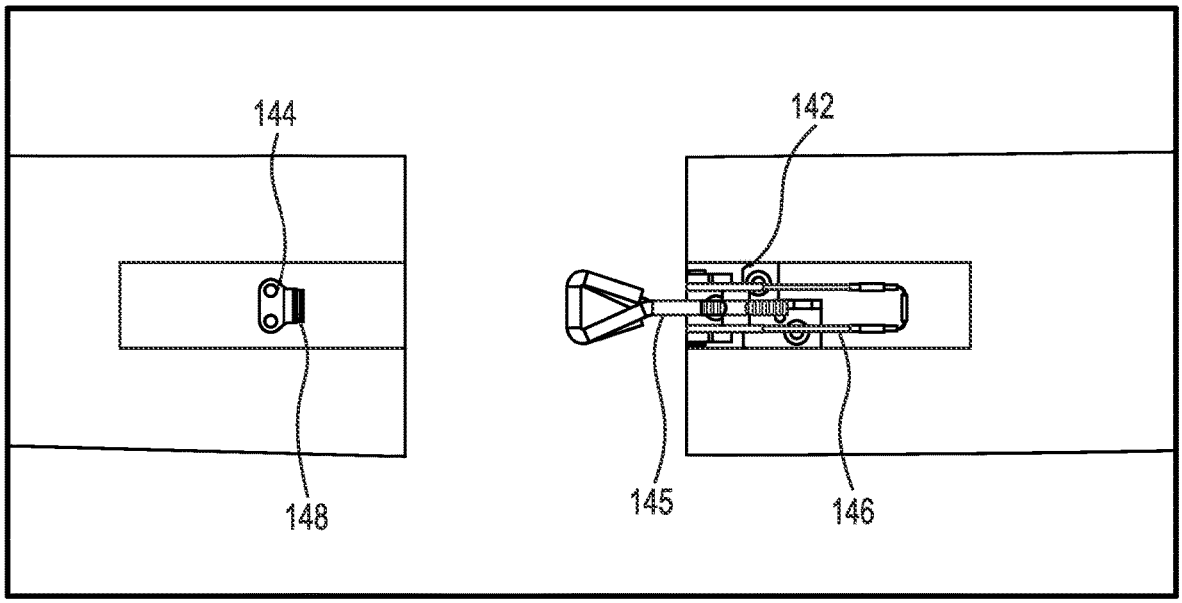
FIG. 11 is a partial closeup side view of a connector of the board of FIG. 9 in a disconnected configuration.
Figure 12:
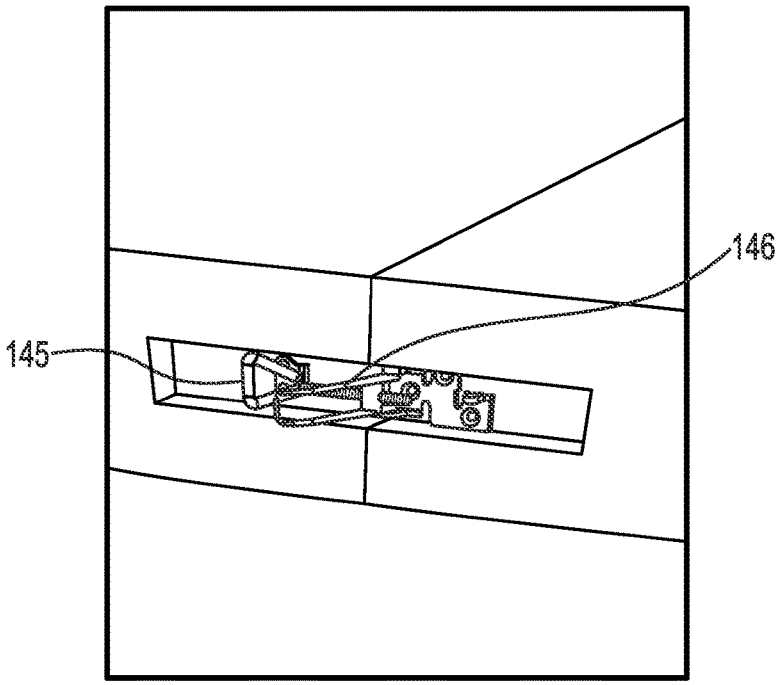
FIG. 12 is a partial closeup side perspective view of a connector of the board of FIG. 9 in an assembled configuration with the connector partially closed.
Figure 13:
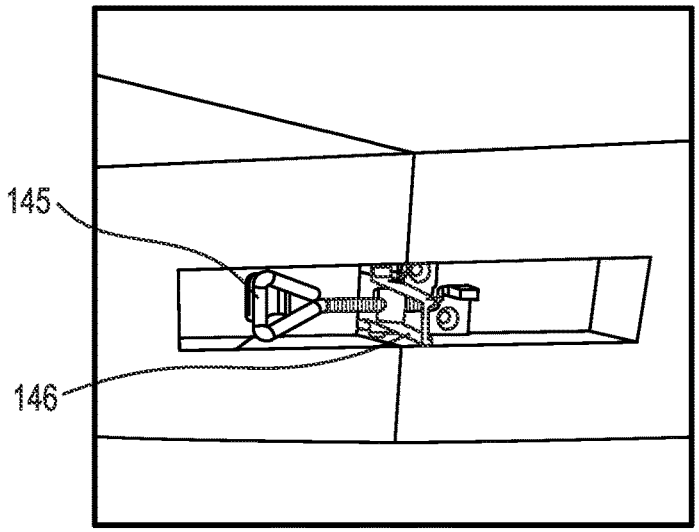
FIG. 13 is a partial closeup side perspective view of a connector of the board of FIG. 9 in an assembled configuration with the connector partially closed.
Figure 14:
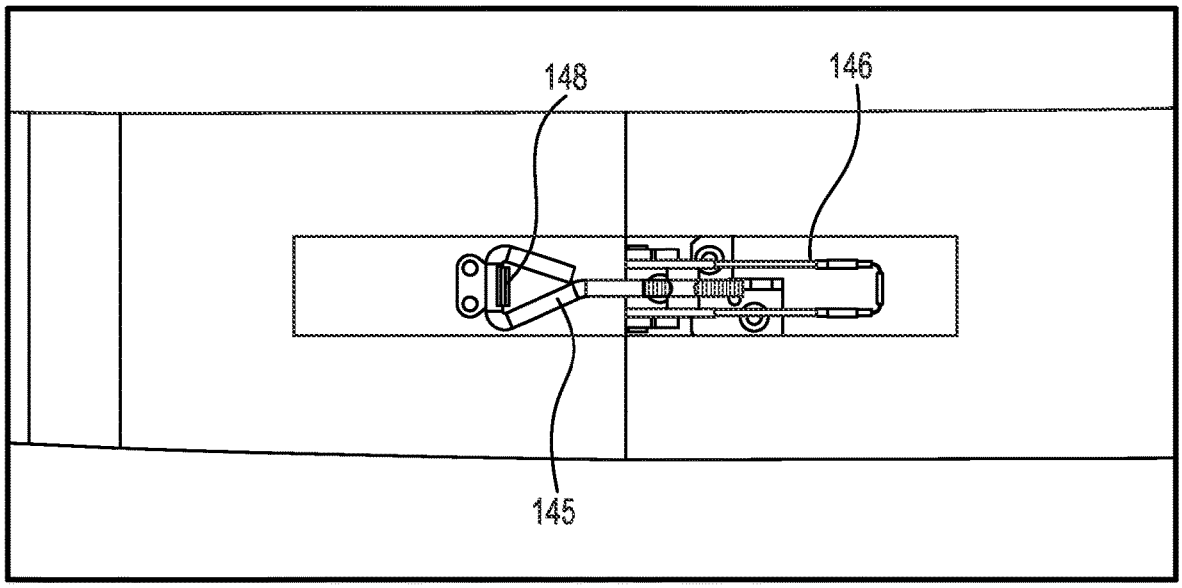
FIG. 14 is a partial closeup side view of a connector of the board of FIG. 9 in an assembled configuration with the connector fully closed.

FIGS. 11-15 show close up images of the connector 140 in various configurations from open to closed. The connector 140 is a latch type toggle clamp including a first component 142 affixed to the front portion 110 and a second component 144 affixed to the back portion 126, although the locations of these components could alternatively be switched. The first component 142 is a latch clamp including an eye bolt 145, which in this case forms a triangular loop but could alternatively have other shapes, and a toggle lever 146 which pivots to slide the eye bolt 145 horizontally forward and back. The second component includes a hook 148, shaped to accommodate the hoop of the eye bolt 145. In FIG. 11, the front and back portions 110, 120 are separated and the connectors are open. FIGS. 12 and 13 show side perspective views of the front and back portions 110, 120 brought together with the hoop of the eye bolt 145 engaged in the hook 148 and the toggle lever 146 pivoting to a partially closed position, while in FIG. 14 the toggle lever 148 has been flipped to the fully closed position, securely connecting the front component 142 to the back component 144 to hold the board 101 together. The use of a toggle lever allows for leveraged force to be applied to the connector 140 for a strong and secure connection with less strength or effort.

Figure 15:
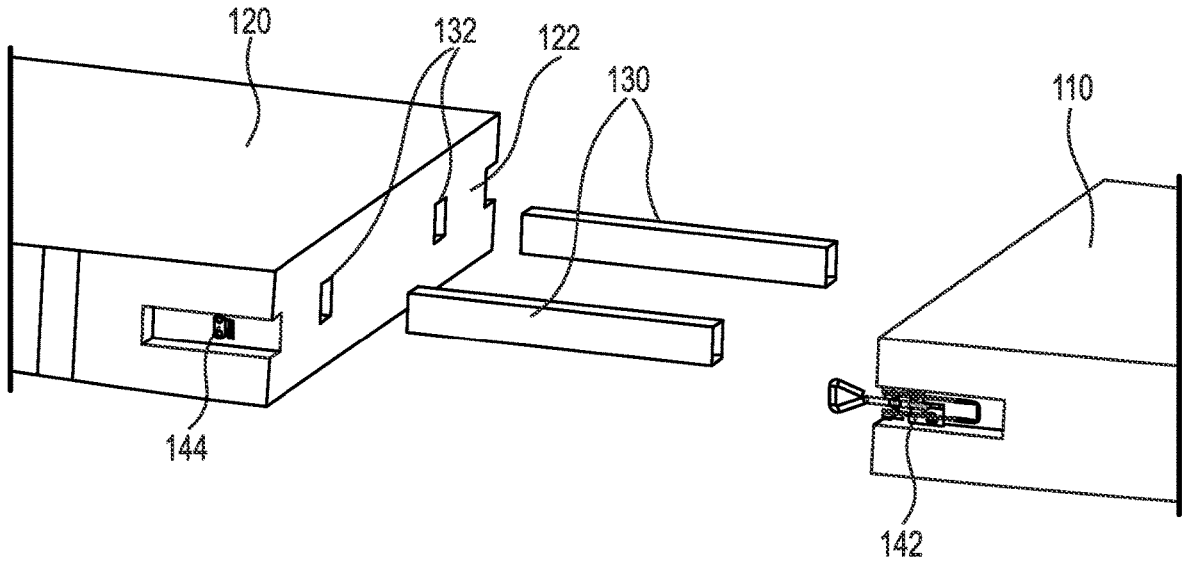
FIG. 15 is a partial side perspective view of the board of FIG. 9 in a disconnected configuration.
Figure 16:
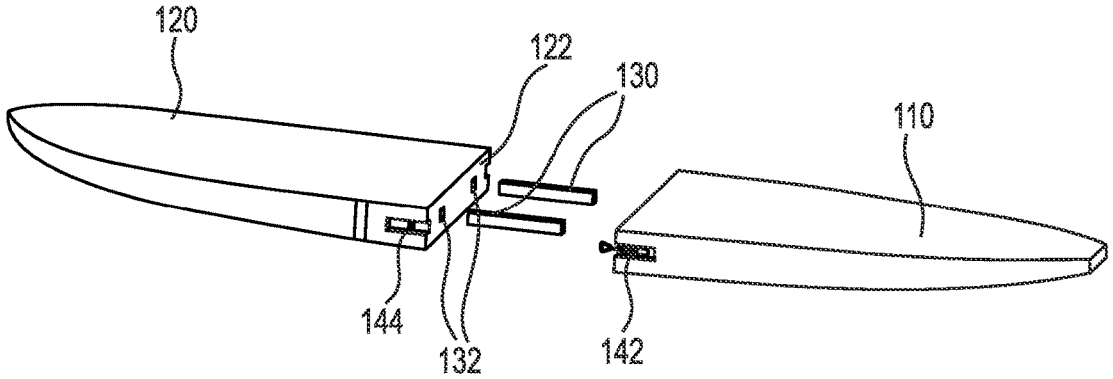
FIG. 16 is a side perspective view of the board of FIG. 9 in a disconnected configuration.
Figure 17:
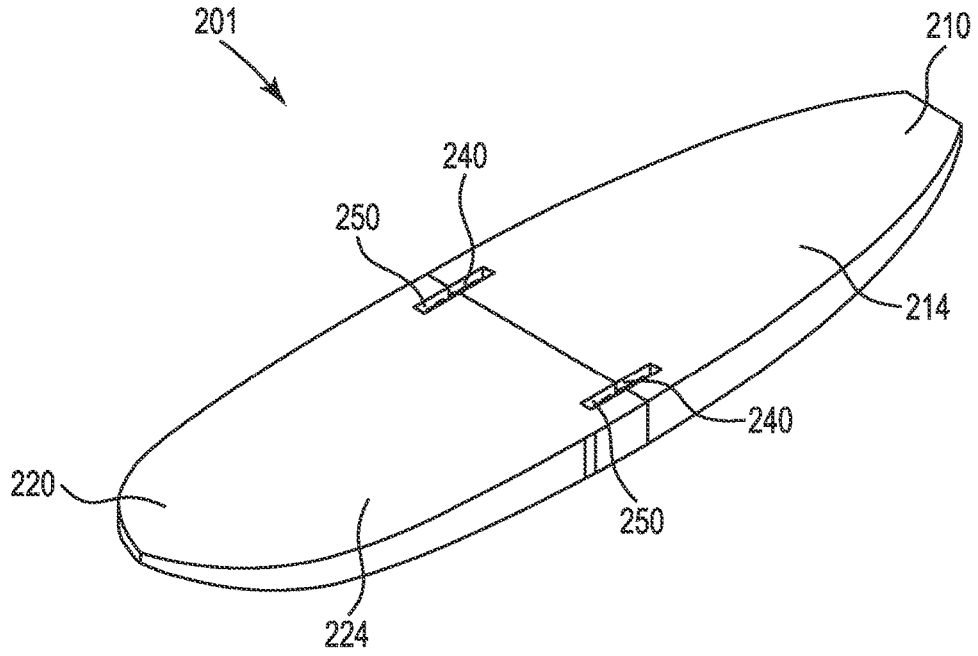
FIG. 17 is a top perspective view of another alternative board according to various embodiments in an assembled configuration for use.
Figure 18:
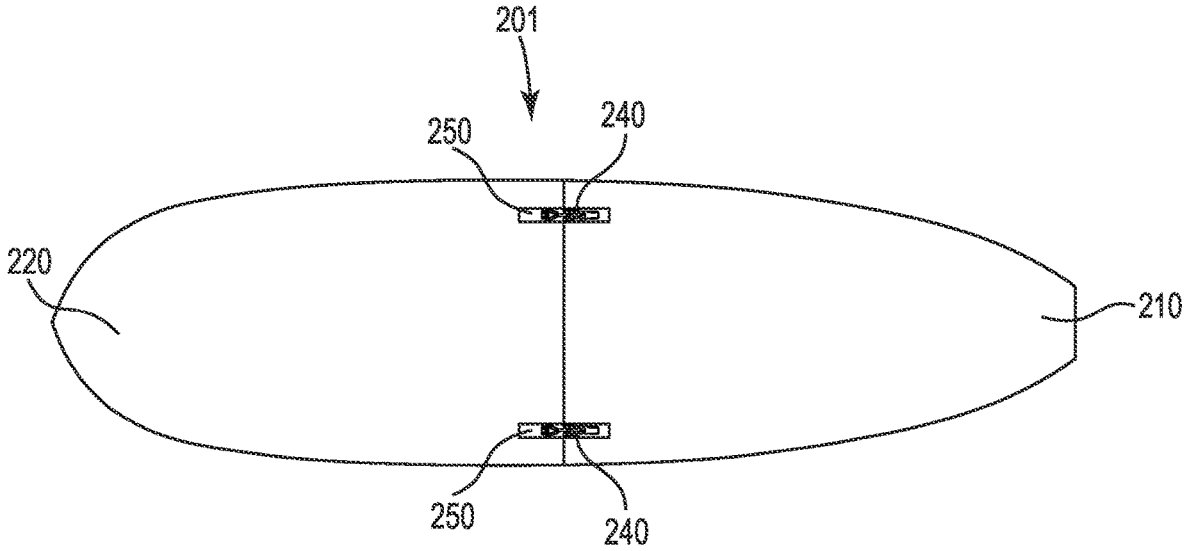
FIG. 18 is a top view of the board of FIG. 17.
Figure 19:
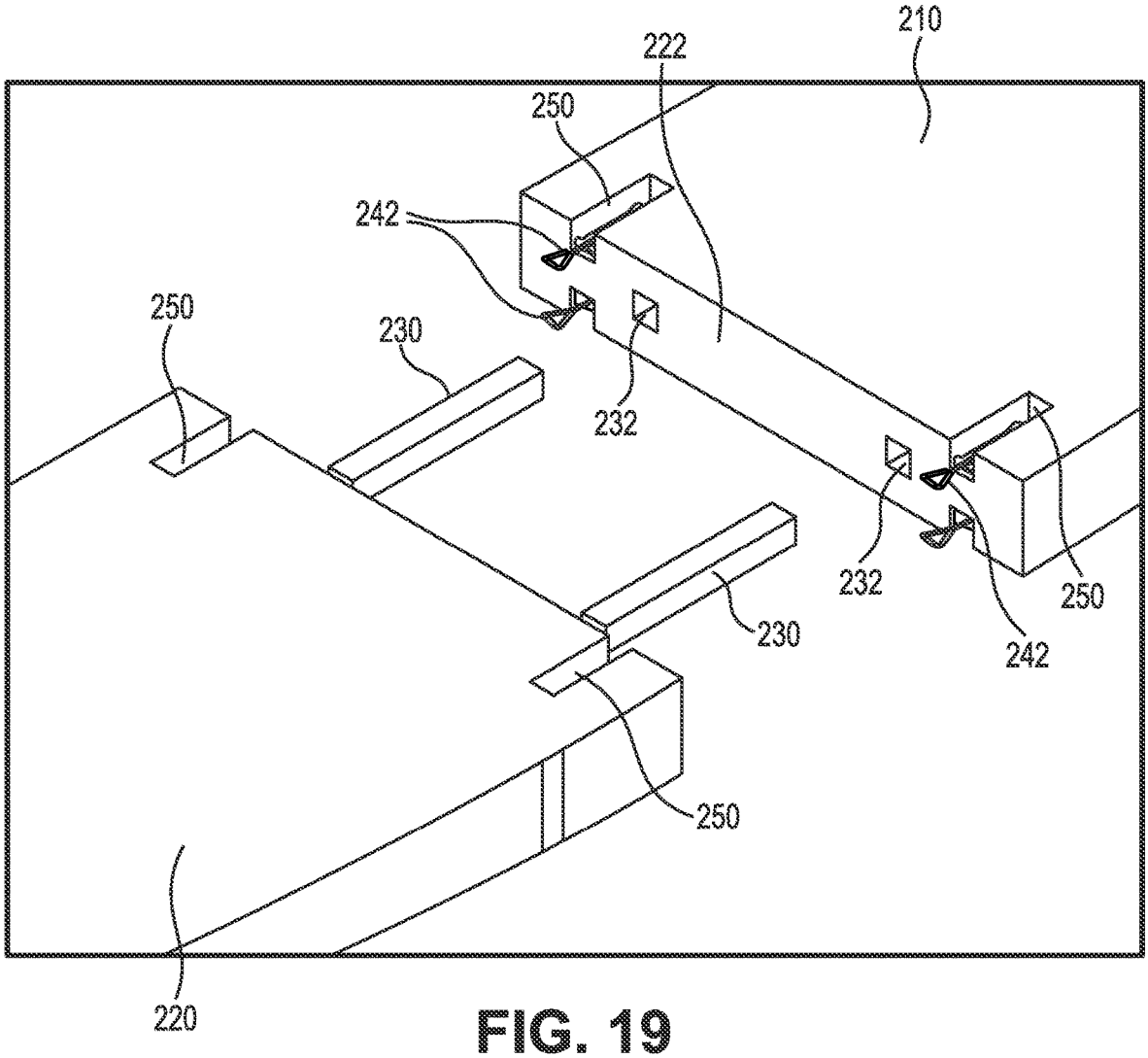
FIG. 19 is a partial closeup side perspective view of the board of FIG. 17 in a disconnected configuration.
Figure 20:
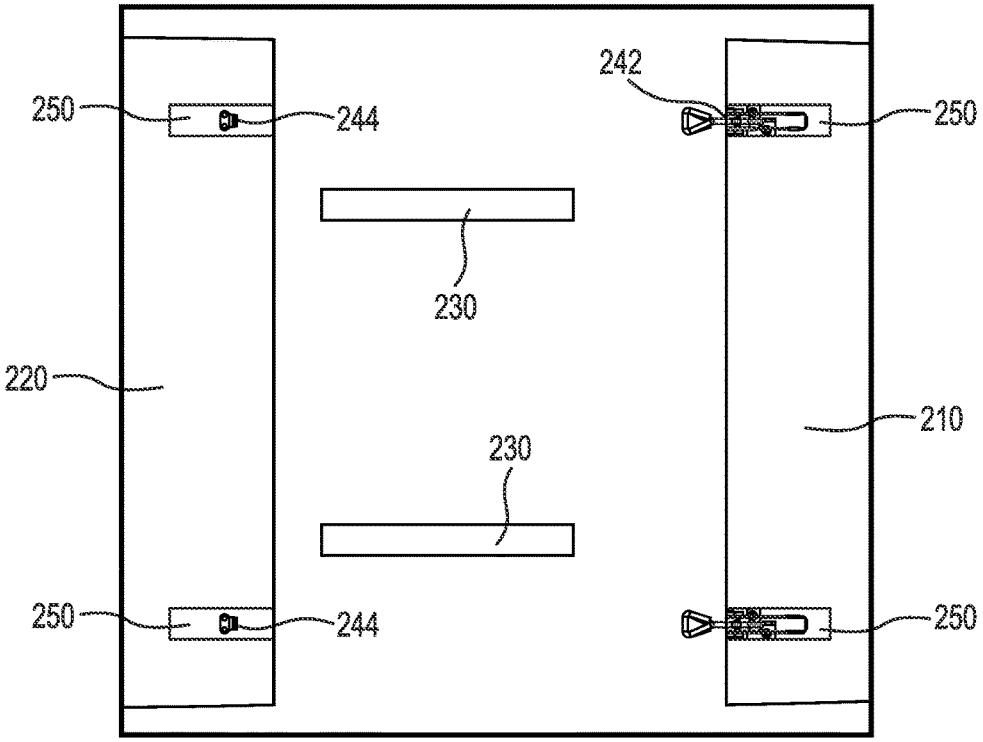
FIG. 20 is a partial top view of the board of FIG. 17 in a disconnected configuration.
Figure 21:
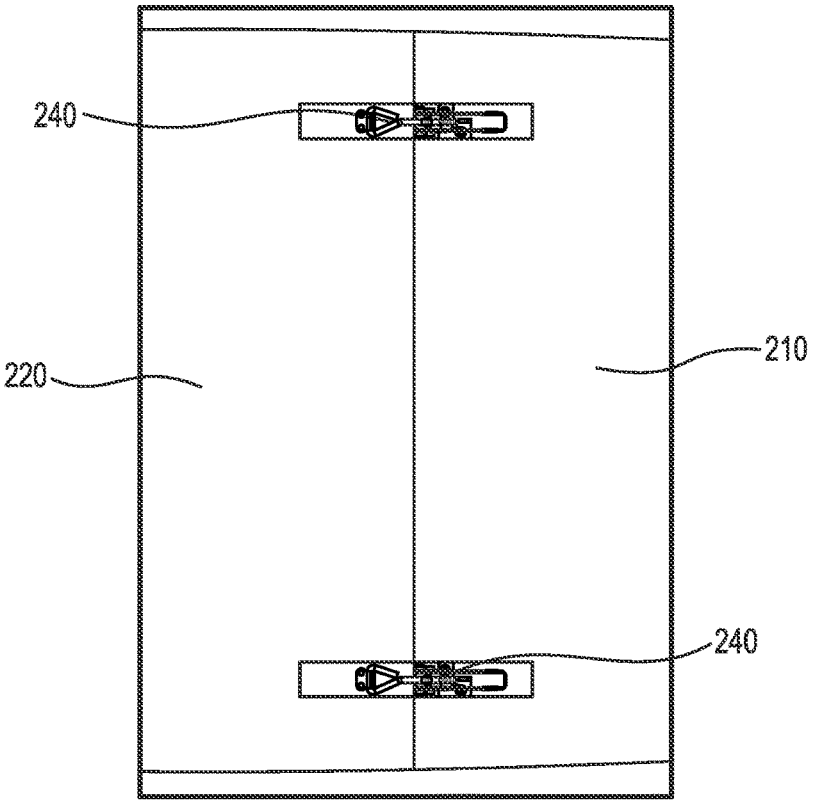
FIG. 21 is a partial top view of the board of FIG. 17 in an assembled configuration.
Figure 22:
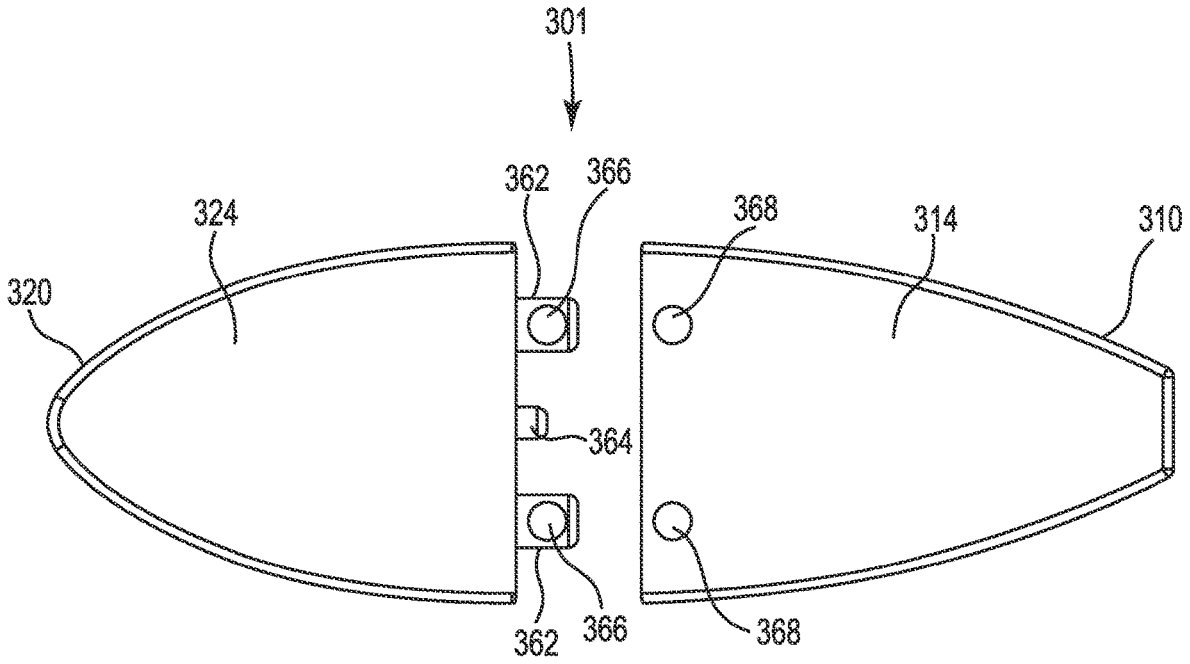
FIG. 22 is a top view of another alternative board according to various embodiments in a disconnected configuration.

FIGS. 15 and 16 show a side perspective view, in closeup and in full view, of the board 101 with the front and back portions 110, 120 separated to reveal another embodiment of a support system within the board 101. In this embodiment, there are only two supports 130. The supports 130 are elongated rods having a square cross sectional shape, symmetrically spaced apart from the central axis of the board 101. As in the previous example, the supports 130 fit within recesses 132 inside the board 101 to provide strength at the connection between the front and back portions 110, 120.

FIGS. 17-21 show still another alternative embodiment. In this embodiment, the board 201 includes connectors 240 which span the connection between the front portion 210 and the back portion 226 of the board. However, in this embodiment, there are four connectors 240 are located in two pairs of spaced recess 250 in the front surface and the bottom surface of the board 201, spanning the front and back portions 210, 206. In this example, the connectors are latch type toggle clamps including front component 242 and back component 244, like connectors 140 including in the previous embodiment, and the supports 230 are a pair of square shaped rods like supports 130 in the previous embodiment. However, other types of connectors and other numbers of varieties of supports, including but not limited to those described elsewhere in this application, could alternatively be used.

A further alternative embodiment is shown in FIGS. 22-27. In this embodiment, the board 301 includes the supports 330 which are not all the same. There are two outer supports 362 which are symmetrically spaced apart from a midline support 364. Each of the supports 330 is shorter than in the previous embodiments, though they could alternatively be longer. In addition, each of the supports 330 is permanently affixed to and/or integrally formed as a part of the front portion 310 of the board 301, though one or more or all of the supports 330 could alternatively be affixed to the front portion 320 of the board 301 or could be entirely removable like the supports of the previous embodiments.

The outer supports 362 each include a circular cavity 366 having an open top and a closed bottom. Alternatively, the circular cavity 366 in the supports could be a through hole. Likewise, the top surface of the board 301 includes a pair of apertures 368 located above the recesses 332 and extend through to the top surface of the board 301 to the recesses 332 within the board 301. The apertures 368 are positioned such that, when the front and back portions 310, 320 of the board 301 are brought together, the apertures 368 align with the cavities 366 in the supports 362.

Figure 23:
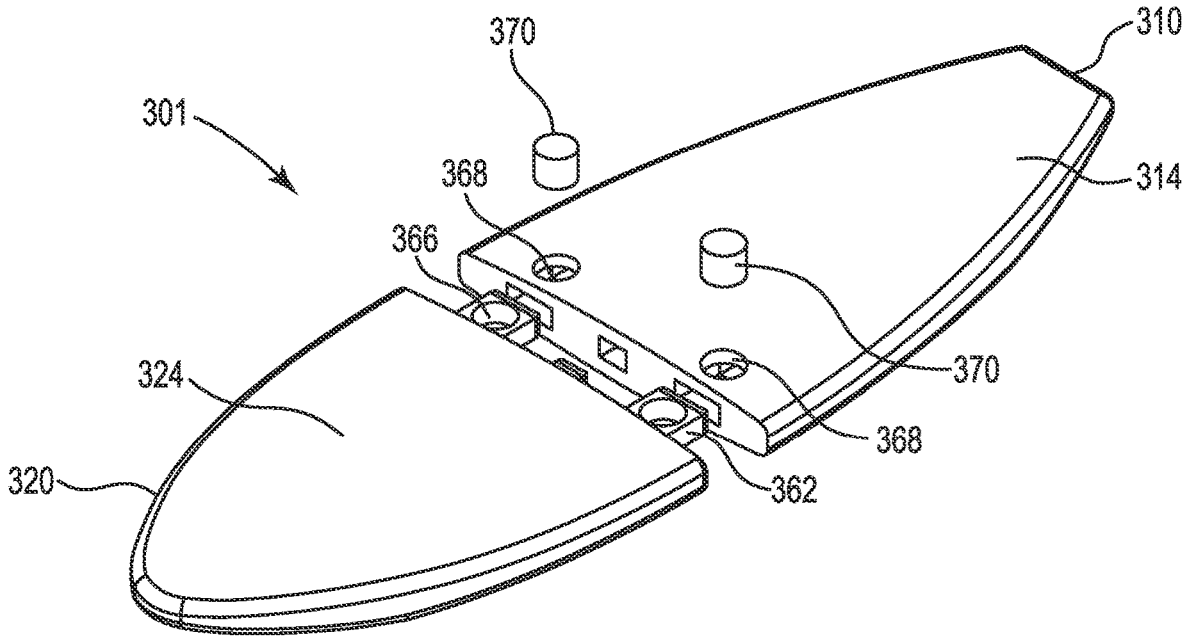
FIG. 23 is a side perspective view of the board of FIG. 22 in a disconnected configuration.
Figure 24:
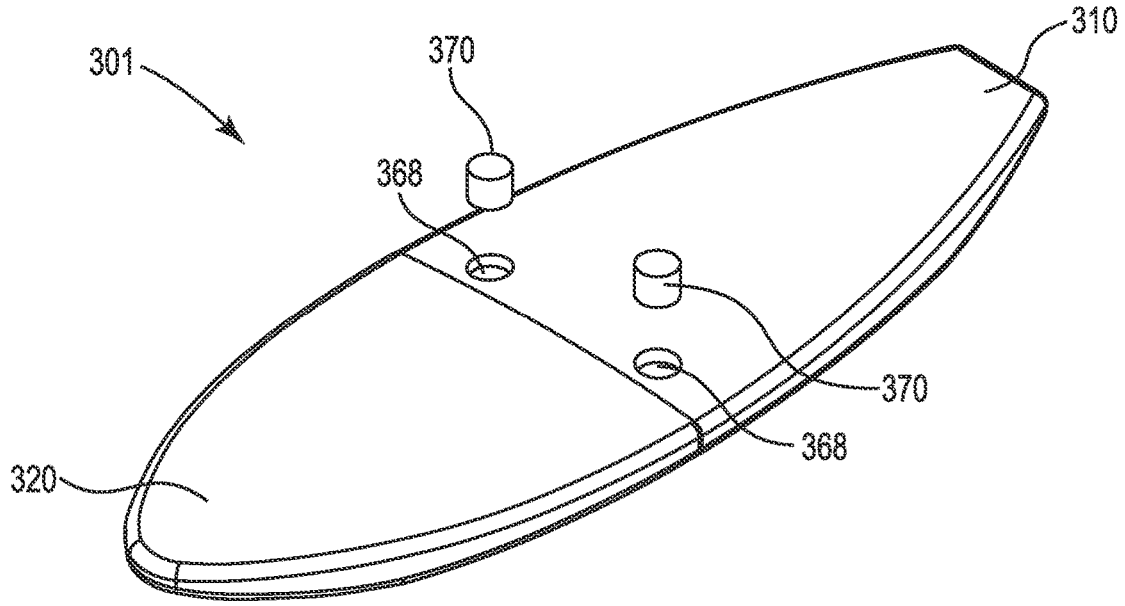
FIG. 24 is a side perspective view of the board of FIG. 22 in a partially assembled configuration.
Figure 25:
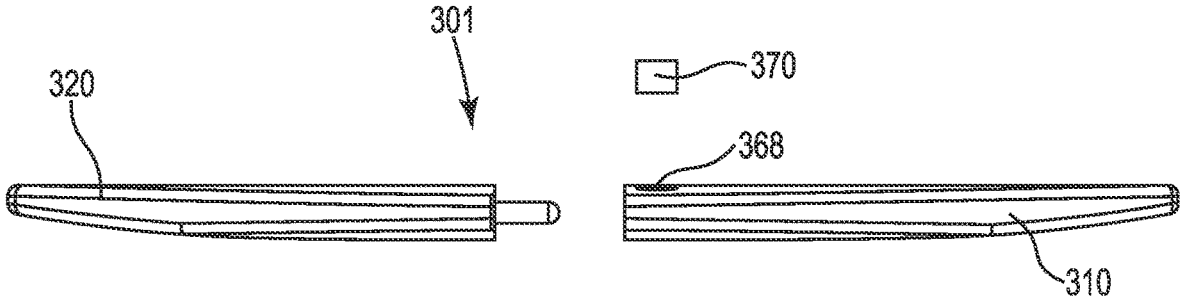
FIG. 25 is a side view of the board of FIG. 22 in a disconnected configuration.

To securely hold the front and back portions 310, 320 together, a fastener 370 acts as a releasable securing connector. The fastener 370 may be inserted from above through the aperture 368 and into the cavity 336 as shown in FIGS. 23-25. The fastener 370 may be sufficiently long to extend into the cavity 366, optionally abutting the bottom of the cavity 366, while also extending through at least a portion of the upper portion of the board 301 above the recess 332 to prevent the front and back portions 310, 320 from separating. Furthermore, the fastener 370 may have a length such that, when fully inserted, it does not extend above the upper surface of the board 301. In some embodiments, the top of the fastener 370 may be flush with the top surface of the board 301 when fully inserted so as not to interfere with a user's feet.

Figure 26:
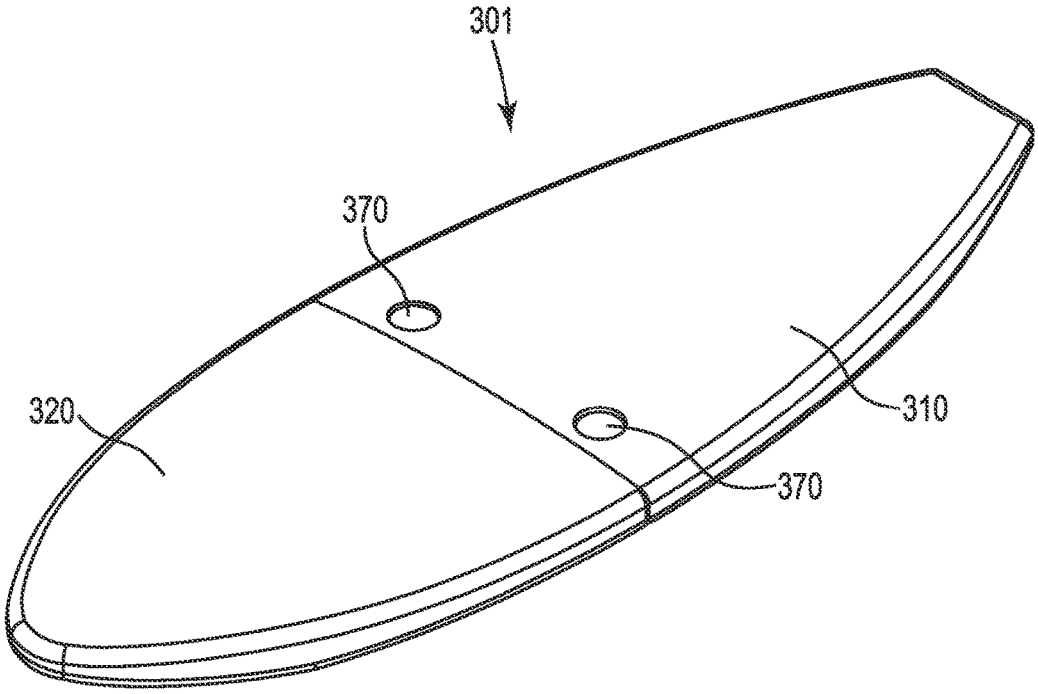
FIG. 26 is a top perspective view of the board of FIG. 22 in an assembled configuration for use.
Figure 27:
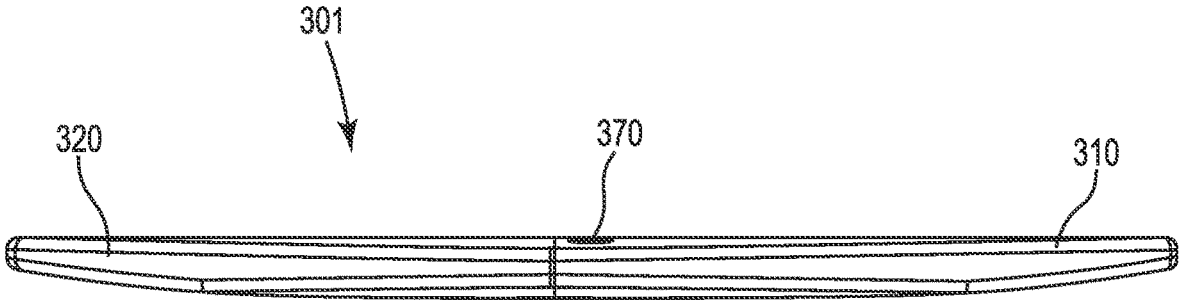
FIG. 27 is a side view of the board of FIG. 22 in an assembled configuration for use.

The fastener 370 may be sized and shape to fit within the aperture 368 and the cavity 366. In the embodiment shown, the fastener 370 has a round profile, while the aperture and the cavity are likewise round, though other shapes could alternatively be used. Furthermore, in the embodiment shown, the fastener 370 is tubular, with an open center and open top. The bottom of the fastener 370 may be either open or closed. In this way, the hollow center of the fastener 370 may function as a container for the user, such as a beverage holder like a cup holder. To accommodate drinks of various sizes such as beverage cans or beverage bottles, the inside diameter of the fastener 370 may be about 2 inches to about 5 inches, or about 3 inches to about 4½ inches. The assembled board is shown in FIGS. 26 and 27 in a top perspective and side view respectively. It can be appreciated that the shorter length of the supports 362 relative results in the fasteners 370 which act as cup holders being more centrally located on the board and therefore within easier reach for the user.

The fastener 370 may be securely retained in the aperture 368 and/or the cavity 366 in one or more ways. For example, because the fastener 370 is inserted from above, it may be held in place by gravity alone. Alternatively or additionally, it may be held by friction between the outside surface of the fastener and the abutting inside surface of the aperture 368 and/or the cavity 366, which may include a close fitting or nesting configuration. In some embodiments, the outside surface of the fastener 370 and/or the inside surface of the aperture 368 and/or the cavity 366 may include a compressible and/or gripping material or liner such as a foam to hold the fastener 370 in place. In some embodiments, the outside surface of the fastener 370 may include threading and the inside surface of the aperture 368 and/or the cavity 368 may likewise include complementary threading for a provide for a threaded engagement of the fastener 370 in the aperture 368 and/or the 366 by twisting the fastener 370 when it is inserted. In some embodiments, the fastener 370 may engage the aperture 368 and/or the cavity 366 through a twist lock mechanism.

This embodiment includes an optional center support 364 which does not connect the front and back portions 310, 320 but rather provides additional element of strength at the potential point of flection when the front and back portions 310, 320 abut each other. This additional support may be particularly helpful in embodiment such as this in which the supports are of a shorter length. While the outer supports 332 are relatively short to keep the fasteners 370 which act as storage spaces more centrally located, the center support, which is short in the embodiment shown, could optionally be longer, like the supports in the other embodiments.

The board 301 may be assembled and disassembled in the same manner as the other embodiments of boards described herein. However, rather than entirely removing the supports 334, 334, one end of the supports 332, 334 remain affixed to either the front portion 310 or front portion 320 while sliding out of the recess 322 in the other of the front portion 310 or the front portion 320.

In this embodiment, the fasteners 370 serve to hold the front and back portions 310, 320 of the board 301 together by securing the outer supports 332 in the cavities 322. To disassemble the board 301, a user can remove the fasteners and slide the front and back portions 310, 320 apart. In alternative embodiments, the board may optionally include other connectors, such as the connectors on the top and/or sides of the board like those shown in other embodiments. Indeed, the supports, connectors, fasteners and other features shown in the various embodiments, and their locations in the front portions or back portions, may be used in other orientations and any combination and are not limited to those presented in the embodiments shown.

While various embodiments have been particularly shown and described with reference to preferred embodiments thereof, it is to be understood that the invention is not limited to the disclosed embodiments. On the contrary, it will be apparent to those skilled in the art that changes may be made.

Certain acts, events, or functions of any of the processes described herein can be performed in a different sequence, may be added, merged, or left out altogether. Thus, in certain embodiments, not all described acts or events are necessary for the practice of the processes. Moreover, in certain embodiments, acts or events may be performed concurrently, e.g., through multi-threaded processing, interrupt processing, or via multiple processors or processor cores, rather than sequentially.

Conditional language used herein, such as, among others, "can," "could," "might," "may," "e.g.," and the like, unless specifically stated otherwise, or otherwise understood within the context as used, is intended in its ordinary sense and is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without author input or prompting, whether these features, elements and/or steps are included or are to be performed in any particular embodiment. The terms "comprising," "including," "having," and the like are synonymous, are used in their ordinary sense, and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list. Conjunctive language such as the phrase "at least one of X, Y and Z," unless specifically stated otherwise, is understood with the context as used in general to convey that an item, term, element, etc. may be either X, Y or Z. Thus, such conjunctive language is not generally intended to imply that certain embodiments require at least one of X, at least one of Y and at least one of Z to each be present.

It should be appreciated that in the above description of embodiments, various features are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that any claim require more features than are expressly recited in that claim. Moreover, any components, features, or steps illustrated and/or described in a particular embodiment herein can be applied to or used with any other embodiment(s). Further, no component, feature, step, or group of components, features, or steps are necessary or indispensable for each embodiment. Thus, it is intended that the scope of the inventions herein disclosed and claimed below should not be limited by the particular embodiments described above but should be determined only by a fair reading of the claims that follow.

I claim:

1. A recreational board in a disassembled configuration for transportation, the recreational board comprising:

a container;

a front portion having a top surface, a bottom surface, an outer edge, and an inner side, the inner side comprising a plurality of recesses;

a back portion having a top surface, a bottom surface, an outer edge, and an inner side, the inner side comprising a plurality of recesses, wherein the inner side of the front portion is configured to abut the inner side of the back portion when the recreational board is assembled into a configuration for use, the front portion and the back portion stacked on top of each other in the container; and a plurality of elongated supports configured to extend between the recesses of the front portion and the recesses of the back portion when the recreational board is assembled into the configuration for use, the plurality of elongated supports being in the container; and a releasable securing element configured to hold the front portion and back portion together when the recreational board is assembled into the configuration for use.

2. The recreational board of claim 1 wherein the plurality of supports are configured to be enclosed within the board when the recreational board is assembled into the configuration for use.

3. The recreational board of claim 1 wherein the plurality of supports comprises at least three supports.

4. The recreational board of claim 1 wherein the board comprises a paddleboard or a surfboard.

5. The recreational board of claim 1 wherein the releasable securing element spans a location at which the inner side of the front portion abuts the inner side of the back portion when the recreational board is assembled into the configuration for use.

6. The recreational board of claim 5 wherein the releasable securing element is located within a recess.

7. The releasable securing element of claim 6 wherein the recess is locating in the outer edge of the front portion and the back portion.

8. The recreational board of claim 1 wherein the releasable securing element comprises a fastener having an inner cavity configured to hold beverages, wherein the fastener is insertable and removable through an aperture in the top surface of the front portion or the top surface of the back portion and secures one of the plurality of supports in place when the board is assembled into the configuration for use.

9. The recreational board of claim 1 wherein the plurality of elongated supports are configured to be inserted and removable from the recesses of the front portion and the back portion.

10. A recreational board in a disassembled configuration for transportation, the recreational board comprising:

a container;

a front portion having a top surface, a bottom surface, an outer edge, and an inner side, the inner side comprising a plurality of recesses;

a back portion having a top surface, a bottom surface, an outer edge, and an inner side, the inner side comprising a plurality of recesses, wherein the side of the front portion is configured to abut the inner side of the back portion when the recreational board is assembled into a configuration for use, the front portion and the back portion in a stacked configuration in the container; and a plurality of elongated supports configured to extend between the recesses of the front portion and the recesses of the back portion when the recreational board is assembled into a configuration for use, wherein the elongated supports are insertable and removable from the recesses when the front and back portions are connected and separated, the plurality of elongated supports being in the container; and a recessed cavity within the outer edge of the front and back portions, spanning a location of abutment between the front portion and the back portion when the recreational board is assembled into a configuration for use;

a releasable locking connector within the cavity, the releasable locking connector comprising a front component attached to the front portion and a back component attached to the back portion.

11. The recreational board of claim 10 wherein the releasable locking connector automatically locks when the front component slides into the back component or when the back component slides into the front component.

12. The recreational board of claim 10 wherein the plurality of elongated supports comprises four supports.

13. A method of assembling a multipiece recreational board, the method comprising the steps of:

a) removing a front portion, a back portion and a plurality of supports from a container, the front portion and the back portion being in a stacked configuration within the container;

b) positioning the front portion of the board on a surface, the front portion comprising: a top surface, a bottom surface, an outer edge, and an inner side, the inner side comprising a plurality of recesses;

c) positioning the back portion of the board on the surface, the back portion comprising: a top surface, a bottom surface, an outer edge, and an inner side, the inner side comprising a plurality of recesses;

(d inserting the plurality of elongated supports into the plurality of recesses of the front portion and/or of the back portion; and then e) sliding the front portion and the back portion together, with the inner side of the front portion abutting the inner side of the back portion and with the elongated supports extending from the front portion to the back portion within the recesses of the front portion and the back portion.

14. The method of claim 13 further comprising, during or after step e), engaging a fastening element to releasably secure the front portion to the back portion.

15. The method of claim 14 wherein the fastening element comprises a pair of connectors located on the outer edge of the board and extending across a location of abutment between the front portion and the pack portion.

16. The method of claim 14 wherein engaging a connector comprises automatically engaging a connector while sliding the front portion and the back portion together in step e).

17. The method of claim 14 wherein one or more of the supports are affixed to the front portion or the back portion and have a free end which includes an aperture.

18. The method of claim 14 wherein the fastening element comprises a cup holder inserted through the top surface of the front portion or the top surface of the back portion to engage the aperture of the free end of the support.

19. The recreational board of claim 1 wherein the container comprises a carrying bag.

20. The method of claim 13 wherein the container comprises a carrying bag.

* * * * *